US005102382A

United States Patent [19]

Center et al.

[11] Patent Number: 5,102,382

[45] Date of Patent: Apr. 7, 1992

[54] METHOD AND APPARATUS FOR CLOSING BOTTOM END FLAPS OF A CARTON

[75] Inventors: John L. Center; William C. Mills, Jr., both of Dallas, Tex.; John R. Plaskett, Chattanooga, Tenn.

[73] Assignee: Recot, Inc., Dallas, Tex.

[21] Appl. No.: 691,371

[22] Filed: Apr. 25, 1991

Related U.S. Application Data

[62] Division of Ser. No. 398,807, Aug. 25, 1989.

[51] Int. Cl.[5] ..... B31B 3/52

[52] U.S. Cl. ..... 493/1; 493/137; 493/183; 53/491

[58] Field of Search ..... 493/1, 121, 136, 137, 493/139, 140, 177, 178, 183, 453; 53/159, 374, 380, 491

[56] References Cited

U.S. PATENT DOCUMENTS

| | | | |
|---|---|---|---|
| 4,515,579 | 5/1985 | Beckett | 493/1 |
| 4,517,784 | 5/1985 | Beckett | 493/1 |
| 4,545,175 | 10/1985 | Beckett | 493/1 |
| 4,584,818 | 4/1986 | Plaskett | 53/374 |
| 4,627,217 | 12/1986 | Plaskett | 53/374 |
| 4,656,810 | 4/1987 | Plaskett | 53/374 |

*Primary Examiner*—William E. Terrell

*Attorney, Agent, or Firm*—Rothwell, Figg, Ernst & Kurz

[57] ABSTRACT

A method and apparatus is disclosed for closing the bottom end flaps of a reusable rectangular carton whereby the carton is disposed in an expanded position with the bottom end flaps biased outward with respect to the carton sidewalls. A sequence controller is programmed to release the bias and fold each bottom end flap in a predetermined sequence. A closure is effected by disposing at least two end flaps in locking relationship to each other.

4 Claims, 8 Drawing Sheets

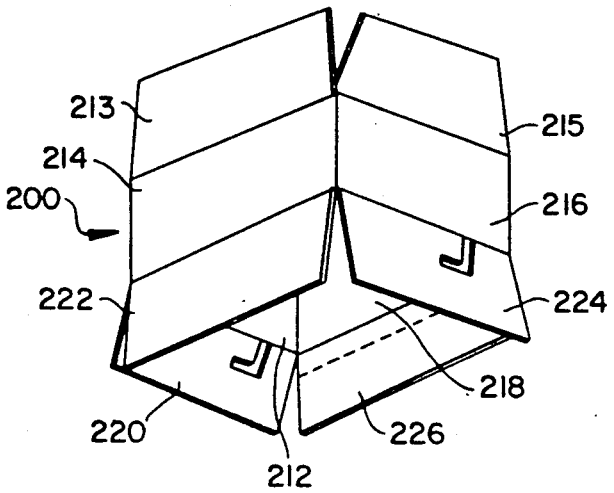
FIG. 2A
FIG. 2B
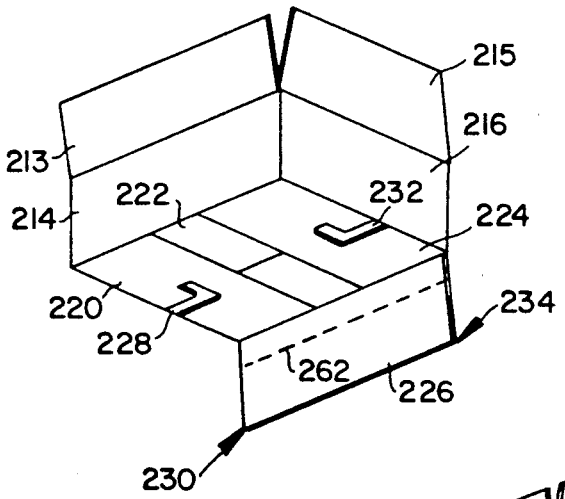
FIG. 2C
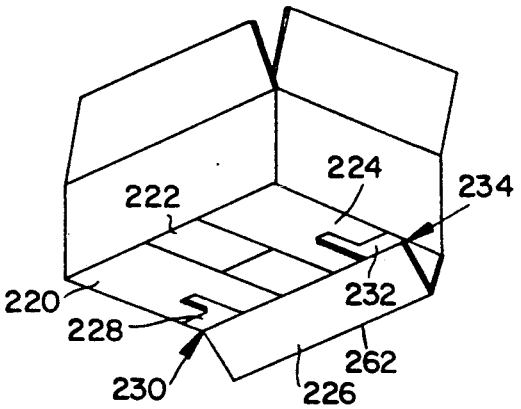
FIG. 2D
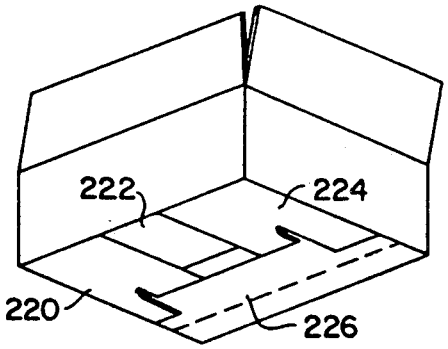

FIG. 5A
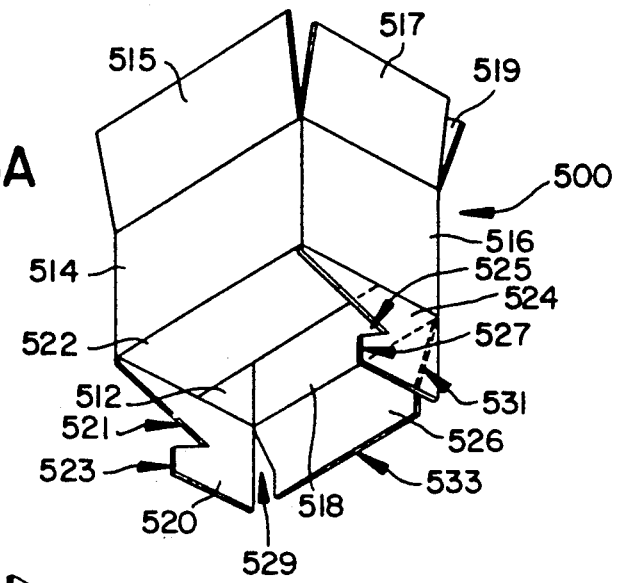
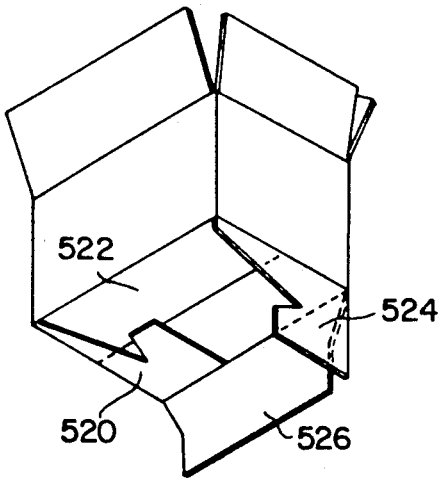
FIG. 5B
FIG. 5C
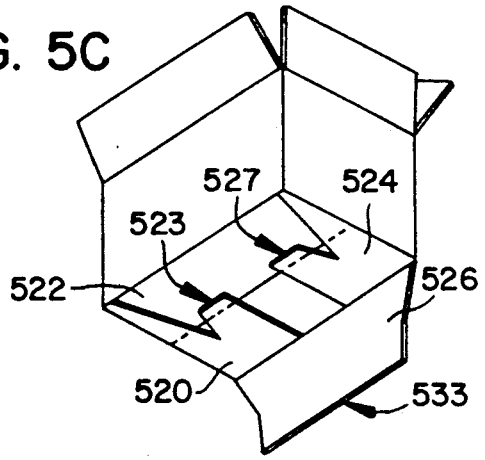
FIG. 5D
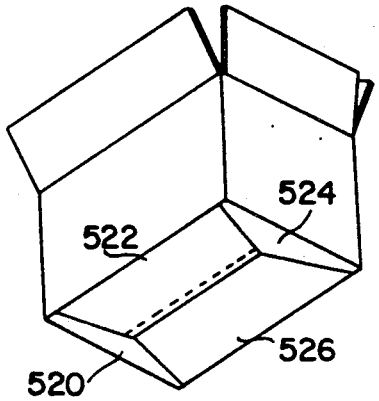

METHOD AND APPARATUS FOR CLOSING BOTTOM END FLAPS OF A CARTON

This is a division of application Ser. No. 07/398,807filed Aug. 25, 1989 pending.

FIELD OF THE INVENTION

The present invention relates to a method and apparatus for closing multiple end flaps of cardboard cartons and the like.

BACKGROUND OF THE INVENTION

Rectangular cartons having foldable end flaps are used by Frito-Lay, Inc., the assignee of the present invention, and others to package bags of snack foods such as potato chips, corn chips, corn puffs and th like for shipment. Typically, the cartons are erected by hand and the bags of product are placed in the carton manually, afterwhich a manual fold is used to close the top of the carton. It is frequently desirable that the cartons be reused. so that destructive closure means for bottom and top closures are to be avoided. Thus, typical automatic devices for closing cartons having closable end flaps which utilize glue, staples, tapes or other destructive closure means are not suitable for applications wherein the carton is expected to be collapsed after the bags of product are removed and returned for reuse. At the same time, the manual process of erecting, filling and closing cartons is costly.

Efforts have been made to automate the packaging of light weight fragile products such as bags of snack foods. An example of an automatic packaging device is disclosed in U.K. Patent Application 2,200,093 to Bishopbarn Ltd. entitled "PACKAGE HANDLING METHOD AND APPARATUS." However, such disclosures do not include an automated device for erecting a carton and creating a secure, reusable bottom closure. Accordingly, full automation of carton erection, wherein a reusable folded bottom closure is formed, the contents are placed in the carton and a folded top closure is made, remains lacking in the art.

One alternative known in the art is the use of folded cartons having an automatic opening an closing permanent bottom that is simultaneously formed when the carton sides are expanded to the desired geometry. The use of an automatic permanent bottom produces and excessive cost as the carton materials are significantly greater than a typical carton design, which reduces the feasibility of automation. Further, an automatic opening and closing permanent bottom case typically includes several additional folds within the flattened carton that add undue thickness to a portion of the folded carton, making stacking and handling of folded permanent bottom cartons, making stacking and handling of folded permanent bottom cartons awkward and problematic, especially when such cartons are intended to be collapsed, stored and returned for reuse.

It is desirable to utilize a simple box design with bottom fold closures to produce a secure bottom closure. Top folding closures and various automated methods for producting top closures are known in the prior art. U.S. Pat. No. 4,584,818 to Plaskett entitled "APPARATUS FOR AUTOMATICALLY CLOSING L-SLIDE LOCK CARTONS" as well as U.S. Pat. No. 4,656,810 to Plaskett entitled "APPARATUS FOR AUTOMATICALLY LOCKING L-SLIDE LOCK CARTONS" demonstrate automated devices that fold and insert a final flap into the L-shaped slots of adjacent end flaps and provide a secure top closure. It is noted however, that the carton described in these patents is presented to the top closure mechanism with all flaps in a folded horizontal position perpendicular to the side walls of the carton.

What is lacking in the prior art is a means to provide automated fold closures for bottom end flaps of an open reusable carton.

Hence, it is an object of the present invention to provide a method for closing the bottom end flaps of a rectangular carton.

This and other objects of the present invention will be obvious to one skilled in the art from the below description of the invention and the attached drawings.

SUMMARY OF THE INVENTION

The present invention relates to a method for closing the bottom end flaps of a rectangular carton having sequentially adjacent first, second, third and fourth sides which form the body of the carton, the four sides having first, second, third and fourth bottom end flaps extending respectively therefrom, the method including the steps of:

(a) providing a carton in an expanded rectangular position having its bottom end flaps extending downward relative to the body of the carton;

(b) providing biasing means to bias said end flaps outwardly with respect to the sidewalls of the body of the carton;

(c) providing a sequence controller for sequentially controlling releases of the biasing means and closing of the bottom end flaps;

(d) closing the bottom end flaps in a preset sequence under control of the sequence controller by releasing the bias and folding each end flap towards the interior of the carton while maintaining a bias on each unfolded end flap; and (e) providing the end flaps in a secure position by means of disposing at least two end flaps in locking relationship to each other.

The sequence of end flap closing is determined with respect to the locking relationship to be utilized between end flaps to provide a secure closed carton bottom. The sequence of closing may be clockwise or counter clockwise fan folding, or may comprise first folding opposing major or minor end flaps followed by closing and securing of the remaining end flaps, or any desired sequence of closing that results in a secure folded bottom.

Means for disposing the end flaps in locking relationships may be L-slide lock arrangements, fan folding locking sequences, fan folding locks of modified end flap configurations, tab locking arrangements and the like.

In one preferred embodiment, the carton bottom end flaps are closed in a fan folded configuration and fan fold locked wherein the locking edges of the first and last end flaps are modified for ease of closing and to provide a secure closure. In another embodiment, the carton bottom end flaps are closed in a fan folded configuration and the finally folded end flap is secured to the first and third end flaps by means of L-slide locks. In yet another preferred embodiment of the invention, a first major end flap of the carton is folded, afterwhich two minor end flaps are folded inward, followed by the folding of the final major end flap which possesses a tab portion at the edge thereof providing tucking and securing means between each of the other three end flaps.

DETAILED DESCRIPTION OF THE INVENTION

In accordance with the present invention, there are provided means for receiving a flat, collapsed, reusable carton having foldable end flaps extending upwardly and downwardly from each side, in a generally upright position, and expanding the folded carton such that opposing side walls are parallel to each other and adjacent side walls are about perpendicular to each other. The four side walls define an interior space. The carton may be expanded by means such as air suction, mechanical cylinders, or pistons designed to pull or push the carton into its open position. The open carton has upwardly extending top closure flaps that remain in a generally upright position so that the carton may be filled. However, prior to placing any contents in the reusable carton, a folded bottom closure must be effected.

A highly efficient automated system is necessary to fold bottom closures. It is critical that the bottom closure be reliably and consistently effected so that when the carton is lifted the contents of the carton do not fall out due to an unsecured bottom closure. As disclosed herein, control of bottom end flaps has been found to be critical for automation of bottom carton closures. Bottom end flaps require positive restraint and outward biasing to prevent end flaps from interfering with the folding and closing of other bottom end flaps. Control is especially necessary in consideration that a carton may be a new unused carton having relatively stiff end flaps lying in approximately the same plain as their respective carton sides, or may be a worn reused carton whose bottom end flaps will exhibit varying degrees of folding when in an unrestrained position.

Effective automation of folded bottom closures must also avoid end flaps folding into the interior of the carton body, which is a special concern pertaining to the first folded end flap. If the first or other folded end flaps extend upwardly and away from a position generally perpendicular to the body sidewalls, it may be impossible to lock the end flaps and secure a bottom closure. Such is not a concern with folded top closures wherein the contents of the carton provide a support mechanism to maintain the end flaps outside of the interior of the carton.

BRIEF DESCRIPTION OF THE DRAWINGS

A method of making an automated effective folded bottom carton closure will be further described herein below with reference to the attached Figures wherein:

FIGS. 2 A–D are perspective, schematic views showing the folded bottom closure of an L-slide lock arrangement wherein a first major end flap is folded prior to folding both minor flaps, afterwhich the second major end flap is folded and locked into L-slide slots disposed in the two minor end flaps;

FIGS. 5 A–D are perspective, schematic views showing a tab closure wherein a first major end flap is folded prior to folding both minor end flaps, afterwhich the final major end flap containing a tab portion at its free edge is tucked under and secured with the other end flaps to form a bottom closure.

DETAILED DESCRIPTION OF THE DRAWINGS

Figure 1A:
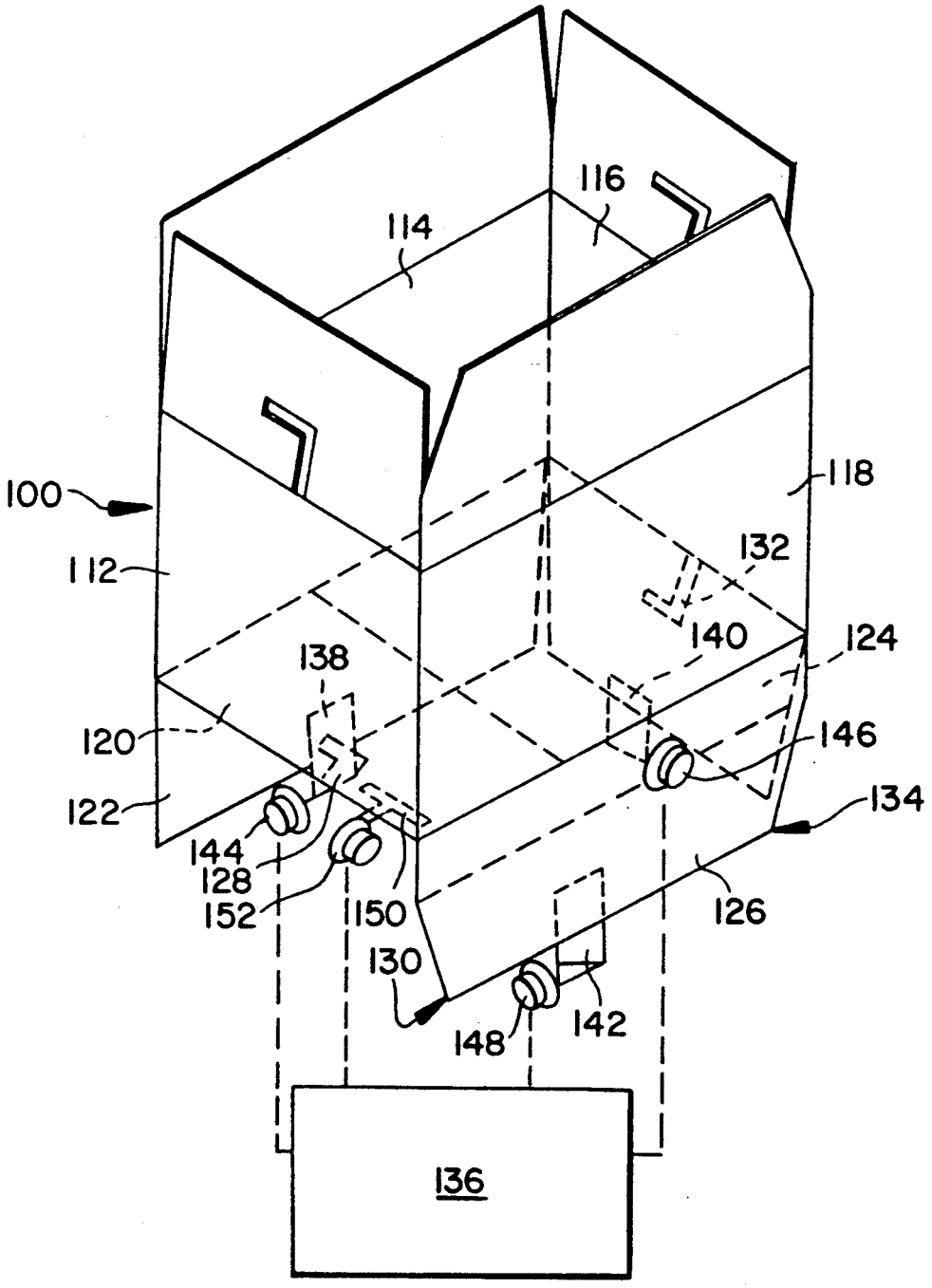
FIGS. 1 A–D are perspective, schematic views showing fan folding of end flaps of a carton having L-slide lock slots receiving opposite free end corners of the final flap to lock the bottom closure securely.

FIGS. 1 A–D illustrate one embodiment of the invention wherein a carton 100 having L-shaped locking slots for locking the carton in its minor end flaps is closed and locked in accordance with the present invention. This embodiment will be described with reference to closing and locking of the bottom flaps of carton 100, but it is recognized that the invention can also be applied to closing of the top flaps of the carton.

The carton 100 shown in FIGS. 1 A–D includes a first side 112, a second side 114, a third side 116 and a fourth side 118. Bottom end flaps 120, 122, 124 and 126 extend downward from sides 112, 114, 116 and 118, respectively. As shown, flaps 120 and 124 are minor end flaps and end flaps 122 and 126 are major end flaps.

Minor end flap 120 includes an L-shaped locking slot 128 for engaging a corner portion 130 of major end flap 126, and according to this embodiment, minor end flap 124 also has an L-shaped locking slot 132 for engaging the opposing corner portion 134 of major end flap 126 so as to lock the flaps closed as hereinafter described.

A sequence controller 136 is programmed to control the flap restraining and closing sequence in accordance with the present invention. In this embodiment, sequence controller 136 sequentially closes the first, second, third and fourth flaps 120, 122, 124 and 126, respectively. Preferably, sequence controller 136 is programmable so that the timing of each of the flap biasing and closing devices hereinafter described can be changed independently, depending upon the type of bottom closure being used.

In order to provide an unobstructed path for closure of the first flap 120, flaps 122, 124 and 126 are biased outwardly with respect to the carton, for example, 10° from vertical, by bias arms 138, 140 and 142, respectively. According to this embodiement, each of the bias arms 138, 140 and 142 are positioned by pneumatic rotary actuators 144, 146 and 148, respectively, under the control of sequence controller 136. However, the bias arms can be positioned by any suitable means, such as servomotors, pneumatic air cylinders and the like.

With flaps 122, 124, and 126 biased out of the way of flap 120, the first flap is closed by being folded toward the interior of the carton by a first closing arm 150. Closing arm 150 is positioned by pneumatic rotary actuator 152 under the control of sequence controller 136, but can be positioned by any suitable means such as a servomotor, pneumatic air cylinder or the like.

With flap 120 held in the position shown in FIG. 1A by closing arm 150, bias arm 138 retracted out of the way of flap 122 by rotary actuator 144 under the control of sequence controller 136.

Figure 1B:
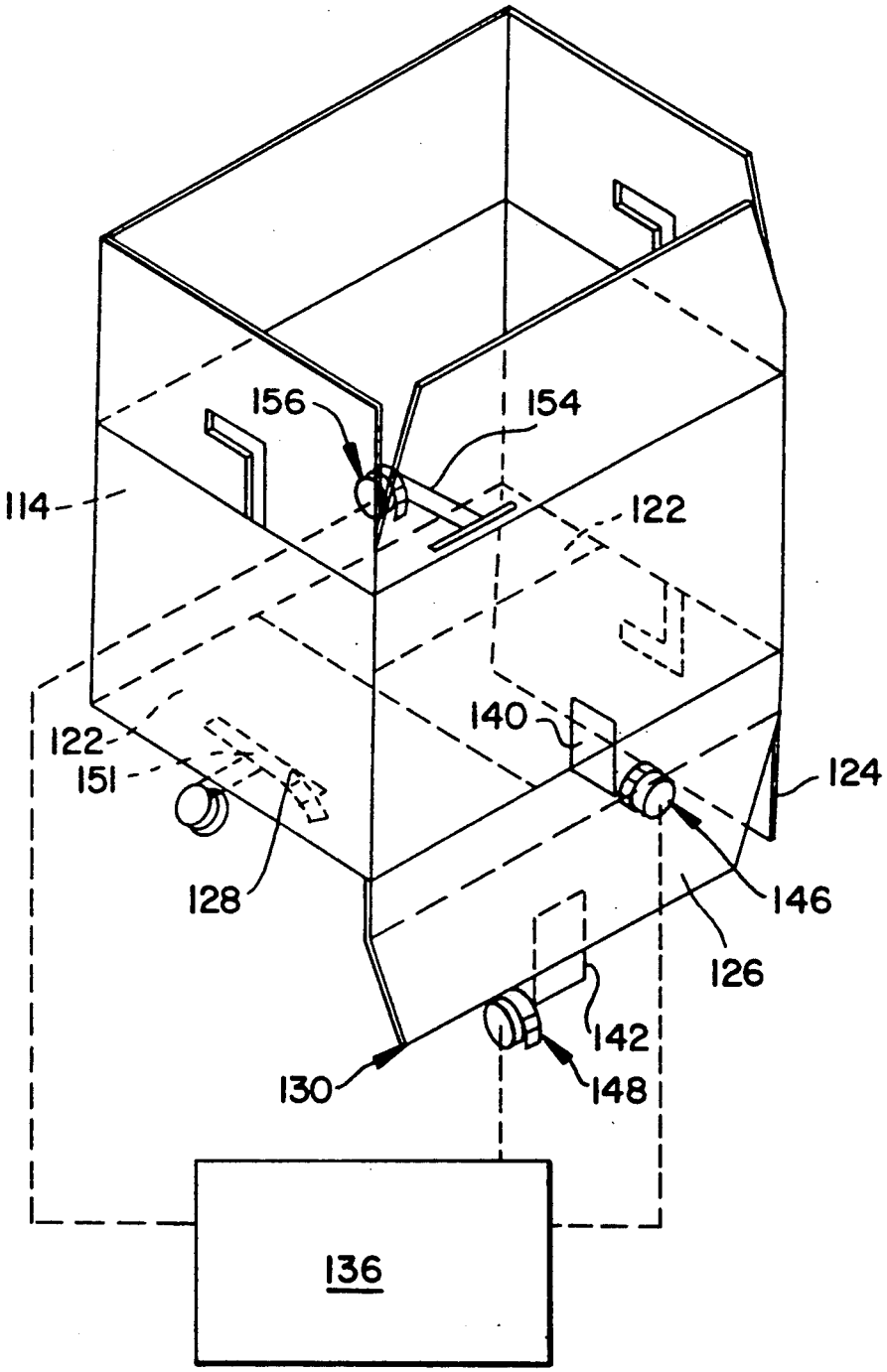

Referring now to FIG. 1B, flap 122 is then closed while flaps 124 and 126 are biased out of the way by bias arms 140 and 142, respectively. Flap 122 is folded inward to about perpendicular to sidewall 114 by closing arm 154, which is positioned by pneumatic rotary actuator 156 under the control of sequence controller 136. With flap 122 held in the position shown in FIG. 1B, closing arm 150 (shown in FIG. 1A) can be retracted by pneumatic rotary actuator 152 under the control of sequence controller 136 and replaced with guide bar 151. Guide bar 151 serves to facilitate the subsequent insertion of the corner portion 130 of major end flap 126 into L-slide slot 128. Optionally, closing arm 150 may be designed with a downwardly curved end, remain in contact with end flap 122 and serve as the guide bar.

Prior to the closing of flap 124, bias arm 140 is retracted by pneumatic rotary actuator 146 under the control of sequence controller 136.

Figure 1C:
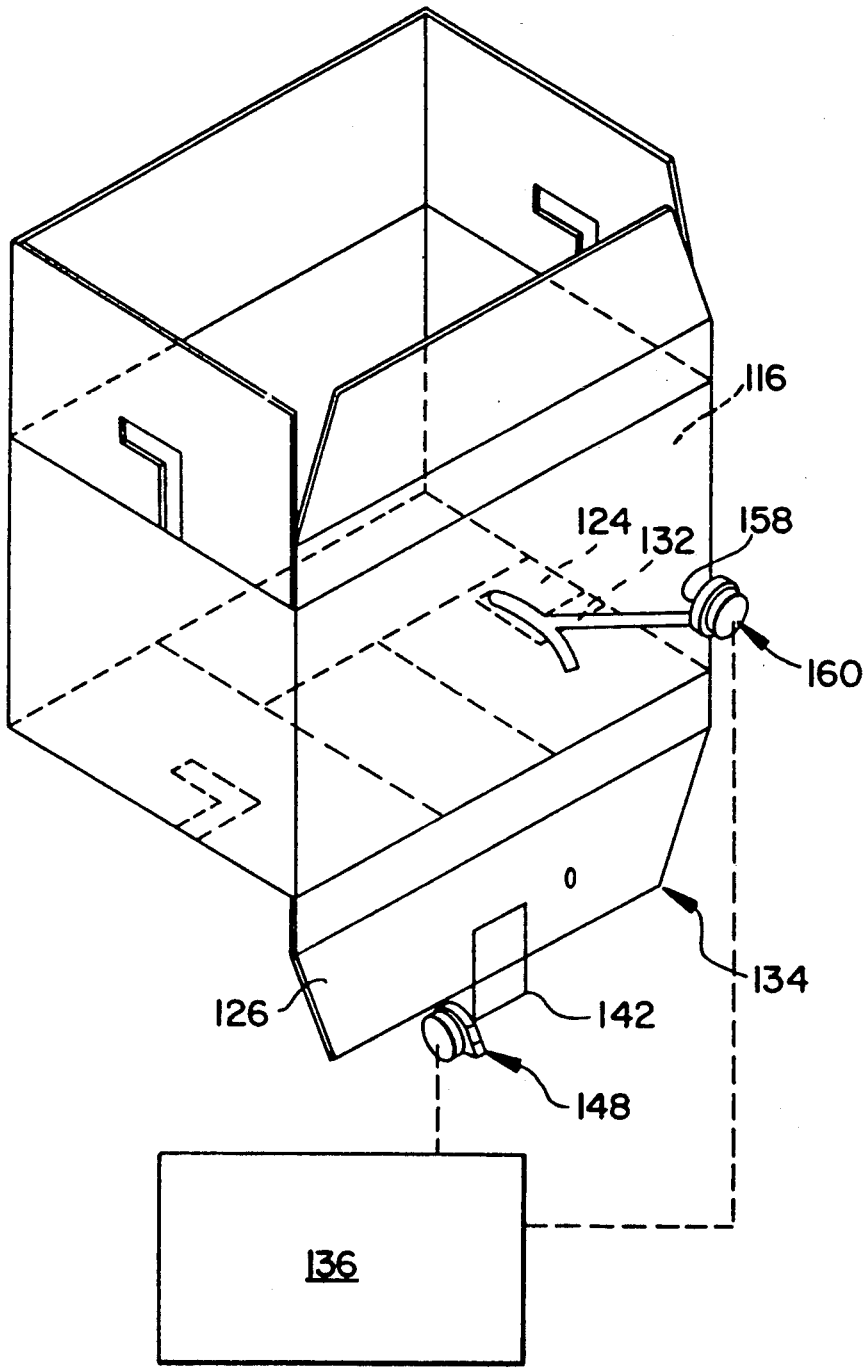

Referring now to FIG. 1C, while flap 126 is biased out of the way of flap 124 by bias arm 142, flap 124 is folded inward to be about perpendicular with sidewall 116 by closing arm 158. Closing arm 158 is positioned by pneumatic rotary actuator 160 under the control of sequence controller 136. closing arm 158 is positioned in part over L-slide slot 132 and possesses a downwardly curved terminal end toward end flap 126. By this design, closing arm 158 also serves as a guide bar for the subsequent insertion of the corner portion 134 of major end flap 126 into L-slide slot 132. While flap 124 is being closed by closing arm 158, closing arm 154 can be retracted from engagement with closing flap 122 by pneumatic rotary actuator 156 under the control of sequence controller 136.

Prior to the closing of flap 126, bias arm 142 is retracted out of the way of closing flap 126 by pneumatic rotary actuator 148 under the control of sequence controller 136.

The closing of the fourth flap 126 and the locking closed of the bottom of carton 100 will now be described with reference to FIG. 1D. In accordance with this embodiment, means are provided for folding the closing flap 126 to form a longitudinal fold 162 in the closing flap 126 at a predetermined position between the bottom end 164 of side 118 of the case, and the free longitudinal edge 166 of flap 126. Preferably, flap 126 has previously been scored along a line at the position where fold 162 is formed.

Figure 1D:
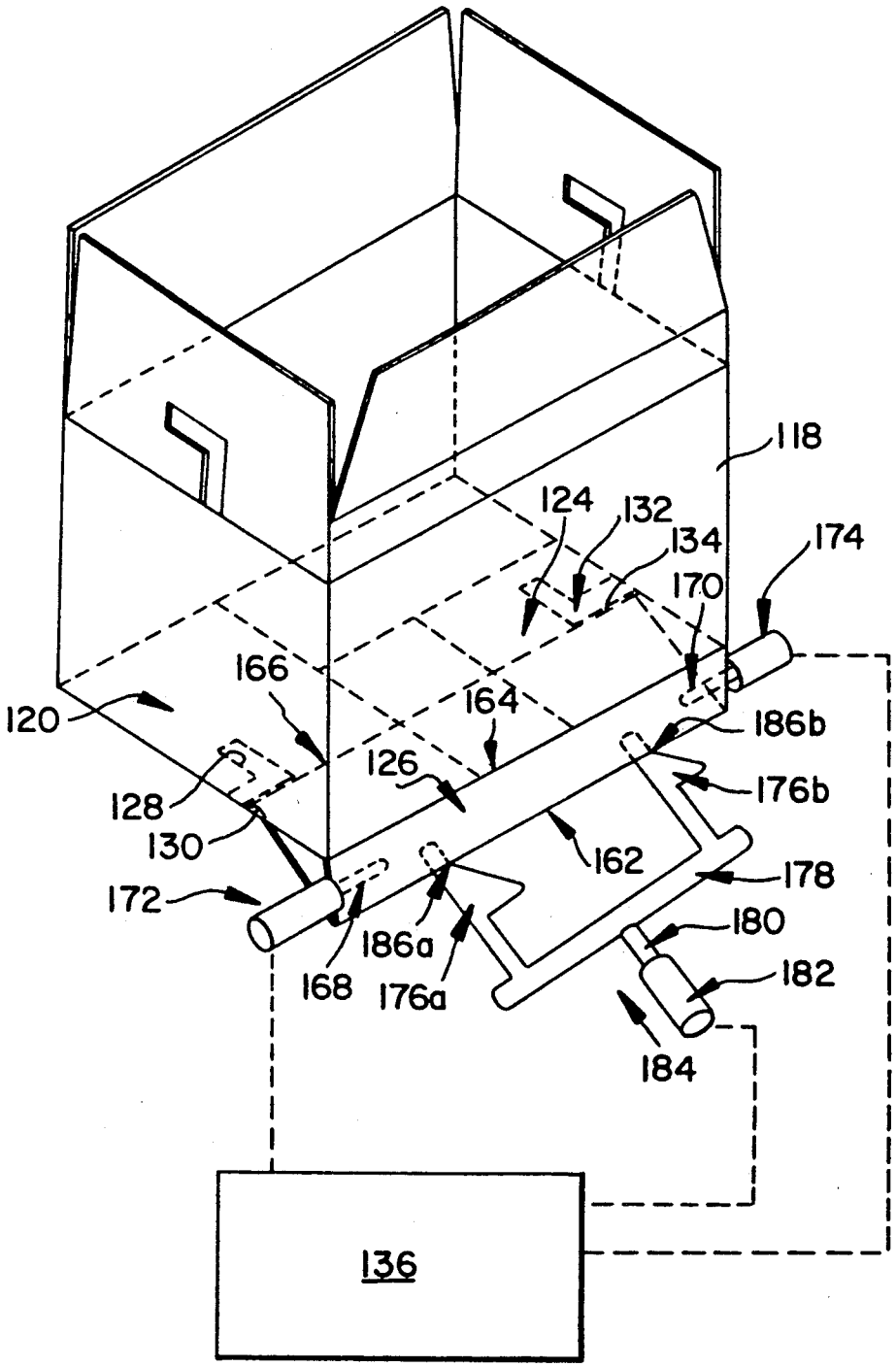

In the embodiment shown in FIG. 1D, the closing flap folding means includes fold support rods 168 and 170 which may be piston rods of cylinders 172 and 174, respectively, which cylinders are rigidly mounted on suitable supports (not shown). The piston rods are selectively positionable to and from a position adjacent the inside surface of flap 126 when flap 126 extends generally parallel to side 118 of the carton. The "inside surface" of flap 126 is that side of the flap facing toward the interior of the carton as distinguished from the "outside surface" which is the side of the flap facing away from the interior of the carton. Flap fold support rods 168 and 170 are selectively positionable to and from the position shown in FIG. 1D by pneumatic cylinders 172 and 174, respectively, each under the control of sequence controller 136.

According to this embodiment, the closing flap folding means includes a pair of flap fold guide shoes **176*a* and 176*b*, fixedly attached to bar 178, that fold the closing flap 126 into the position shown in FIG. 1D when pneumatic cylinder 182, under the control of sequence controller 136, partially extends piston rod 180 in the direction of arrow 184. The partial extension of piston rod 180 brings notches 186*a* and 186*b* of the guide shoes 176*a* and 176*b*, respectively, into engagement with fold line 162 of flap 126. After which, flap fold support rods 168 and 170 are withdrawn from the position shown in FIG. 1D by pneumatic cylinders 172 and 174, respectively, under the control of sequence controller 136. At this point, corners 130 and 134 of flap 126 are adjacent flaps 120 and 124, respectively, and in position to be slid into the L-shaped locking slots 128 and 132**, respectively.

Guide shoes **176*a* and 176*b* provide the means for tucking the opposite free end corners 130 and 134 of closing flap 126 into respective L-slide lock slots 128 and 132. Shoes 176*a* and 176*b* guide the longitudinal fold 162 of closing flap 126 to a position at about a level with the top of the case to cause each of the free end corners to enter the respective L-shaped slots due to the resiliency of the folded top flap, thereby completely closing the case. This is accomplished by continued inward movement of shoes 176*a* and 176*b* from the position shown in FIG. 1D in the direction of arrow 184 under the power of cylinder 182. Piston rod 180** then can be retracted in preparation for the closing of the bottom of another box.

The invention also includes folded bottom closures wherein the bottom end flaps are folded in a sequence other than a fan folded sequence, such as the L-slide lock arrangement shown in FIG. 2. In this embodiment a folded reusable carton 200 having adjacent sidewalls 212, 214, 216, 218; respective top extending end flaps 213, 215 shown and 211, 217 not shown in the Figure; and respective bottom extending end flaps 220, 222, 224, and 226, is disposed in an expanded position wherein adjacent sidewalls are about perpendicular.

Major bottom end flap 222 is first folded to a horizontal position about perpendicular to sidewall 214 by means discussed in FIG. 1B above, while the remaining ends flaps 220, 224 and 226 are outwardly biased with respect to the carton sidewalls, by means not shown in the drawing. With major end flap 222 held in a folded position, the bias restraints on minor end flaps 220 and 224 are released and the minor end flaps are both folded to a horizontal position in touching contact with major end flap 222 by closing means not depicted. This configuration is shown in FIG. 2B.

The minor end flaps 220 and 224 contain L-slots, 228 and 232, respectively, positioned to engage end corners 230 and 234, respectively, of the final closing flap, major end flap 226.

As depicted in FIG. 2C the L-slide lock apparatus described in FIG. 1D bends the final closure flap 226 along a line 262 and disposes the end corners 230 and 234 of end flap 226 adjacent to L-slide slots 228 and 232. The closing means used to fold minor end flaps 220 and 224 can also serve to guide the end corners 230 and 234 of final closure flap 226 into the L-slide slots 228 and 232.

Upon full engagement of corners 230 and 234 into L-slide slots 228 and 232, a secure folded bottom closure is achieved, as shown in FIG. 2D.

Figure 3A:
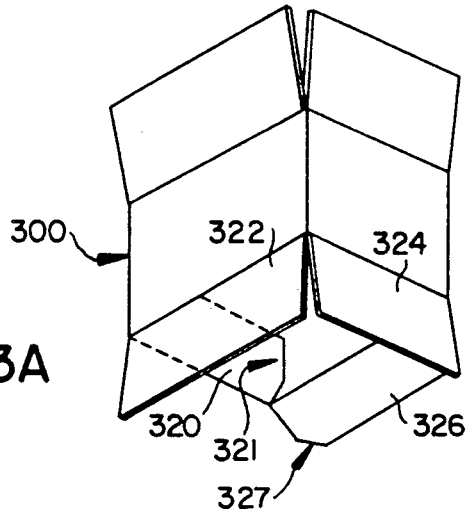
FIGS. 3 A–D are perspective, schematic views showing a fan folded sequence for a returnable carton utilizing modified end flaps to form a secure bottom closure.
Figure 3B:
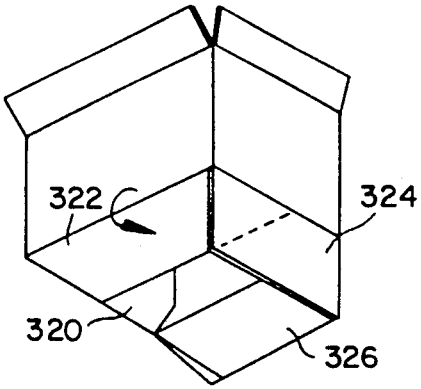
Figure 3C:
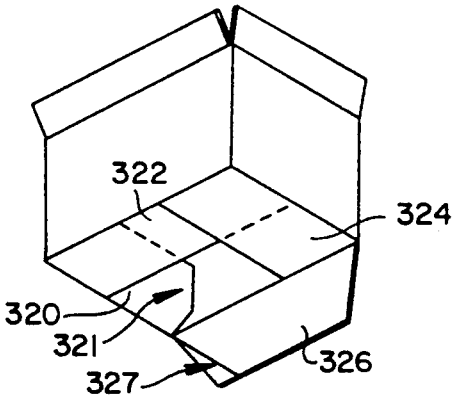
Figure 3D:
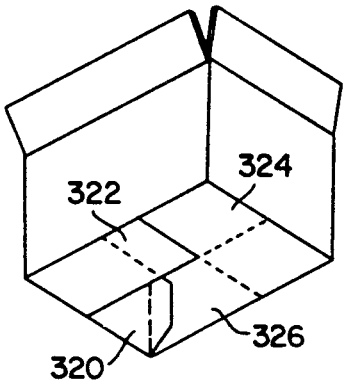

The invention also is applicable to boxes having end flaps of the type shown in FIGS. 3A–D. According to this embodiment, the first flap 320 of a carton 300 differs from conventional rectangular flaps by having an inwardly inclined edge 321 on the side thereof intended to contact the final end flap after fan folding. The second and third flaps 322 and 324, respectively, of carton 300 are conventional rectangular end flaps. The fourth end flap 326 has an inwardly inclined edge 327 which is engaged with and tucked under the inwardly inclined edge 321 of the first flap so as to lock the flaps closed after sequentially fan-folding flaps 320, 322 and 324 as shown in FIGS. 3A-C, respectively. To lock the flaps closed in the final step, edge 327 of flap 326 is pushed past edge 321 of flap 320, thereby tucking edge 327 under a portion of flap 320 to lock the flaps closed.

In FIGS. 4A-D, a carton 400 having four adjacent sidewalls, 412, 414 shown, and 416 and 418 not shown, and conventional rectangular downwardly extending end flaps, 420, 422, 424 and 426, respectively, are fan-folded in a sequence and by means as earlier described with reference to FIGS. 1A-C above.

Figure 4A:
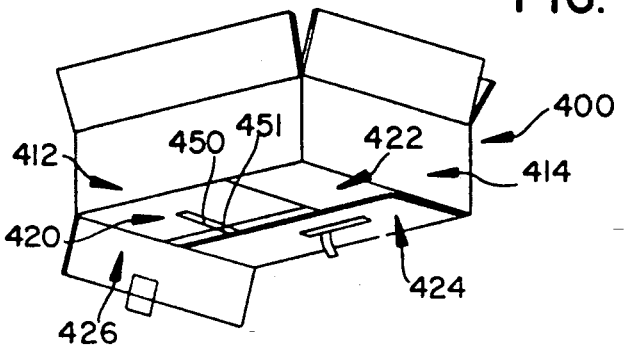
FIGS. 4 A–D are perspective, somewhat schematic views showing a fan folded arrangement for a reusable carton having conventional end flaps.

In addition to the above, closure arm 450 for first folded flap 420 includes a retractable edge 451 which grasps the edge of end flap 420. FIG. 4A shows the carton 400 having bottom closure flaps 420, 422 and 424 in a folded position.

Figure 4B:
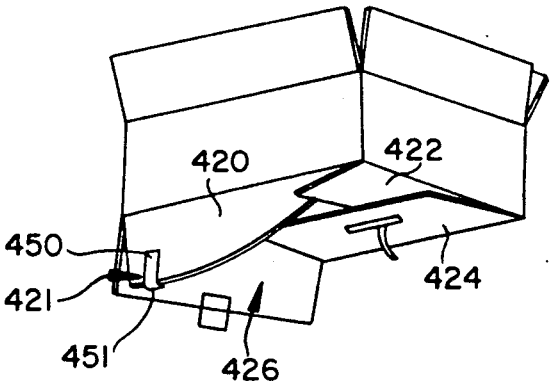

As shown in FIG. 4B, final closure flap 426 is biased outward from its respective sidewall 418 (not shown). The exposed corner 421 of first folded flap 420 is retracted by grasping edge 451 of closure arm 450, and pulled to a position about parallel with sidewall 412.

Figure 4C:
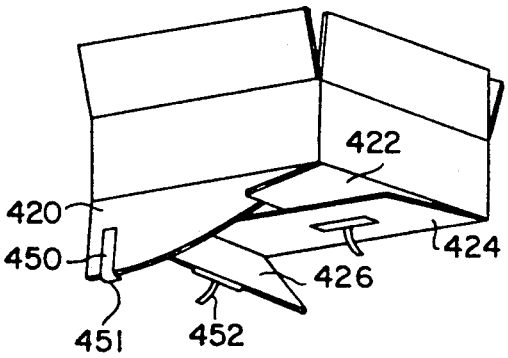

The bias restraint on final closure flap 426 is shown released in FIG. 4C and a closure arm 452, which may be operated by a servomotor, pneumatic air cylinder or the like is used to fold the end flap 426 past the open, extended edge of end flap 420 and to dispose the end flap 426 on a position about perpendicular to its respective sidewall.

Figure 4D:
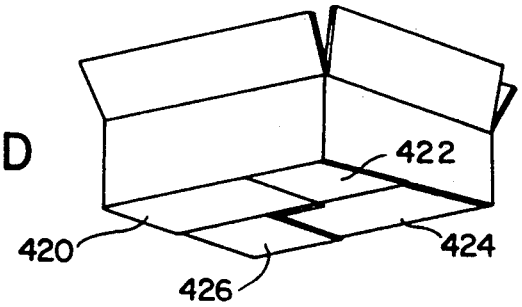

The grasping edge 451 of closure arm 450 releases end flap 420 and the closure arm 450 returns the end flap to a uniform folded position, now with a portion of final end flap 426 tucked inside to complete a full automated fan fold bottom closure. The secure bottom closure is depicted in FIG. 4D.

In yet another embodiment, FIGS. 5A-D depict a collapsible, reusable carton 500 having sidewalls 512, 514, 516, and 518 with upwardly extending top flaps, 513 (not shown), 515, 517 and 519 respectively, and downwardly extending bottom flaps, 520, 522, 524, 526, respectively. Minor end flaps 520 and 524 possess angular cut-outs, 521 and 525 respectively, and tabs, 523 and 527 respectively. Major end flap 526 possesses angular side edges 529 and 531 and an extended longitudinal edge 533 that acts as a closure tab, as is described below.

As described earlier with respect to FIGS. 2A-C, the bottom end flaps of carton 500 depicted in FIGS. 5A-C are folded in sequence whereby major end flap 522 is first folded, FIG. 5A; followed by in-folding minor end flap 520, FIG. 5B; and minor end flap 524, FIG. 5C. It is noted that tabs 523 and 527 are in touching contact with major end flap 522.

A closure arm, not shown, folds final closure flap 526 inward, pushing tabs 523 and 527 and longitudinal edge 533 past the edge of the major end flap 522. This tucks the tabs of minor end flaps 520 and 524 as well as the closure tab edge of major end flap 526 under a portion of first-folded major end flap 522 to lock the bottom flaps in a secure, closed position.

While the invention has been described with reference to specific closing sequences and folded closing arrangements, the above discussion is intended to be exemplary and not limitative of the invention. Modifications and alterations to the drawings are evident to those skilled in the art after reading this disclosure and are intended to fall under the spirit and scope of this invention, which is defined in the appended claims.

We claim:

1. A method for closing the bottom end flaps of a rectangular carton having sequentially adjacent first, second, third and fourth sides which form the body of the carton, the four sides having first, second, third and fourth bottom end flaps extending respectively therefrom, the first and third end flaps having L-slide slots therein to receive the free corners of the fourth end flap, the method including the steps of:

(a) providing a carton in an expanded rectangular position having its bottom end flaps extending downward relative to the body of the carton;

(b) providing biasing means to bias said end flaps outwardly with respect to the sidewalls of the body of the carton;

(c) providing a programmable sequence controller for sequentially controlling release of the biasing means and closing of the bottom end flaps;

(d) closing the bottom end flaps in a preset sequence of first, second, third and fourth end flaps under control of the sequence controller by releasing the bias and folding each end flap towards the interior of the carton while maintaining a bias on each unfolded end flap; and (e) providing the end flaps in a secure position by means of inserting the free corners of the fourth end flap into L-slide locks in the first and third end flaps.

2. A method for closing the bottom end flaps of a rectangular carton having sequentially adjacent first, second, third and fourth sides which form the body of the carton, the four sides having first, second, third and fourth bottom end flaps extending respectively therefrom, the first and third end flaps having L-slide slots therein to receive the free corners of the fourth end flap, the method including the steps of:

(a) providing a carton in an expanded rectangular position having its bottom end flaps extending downward relative to the body of the carton;

(b) providing biasing means to bias said end flaps outwardly with respect to the sidewalls of the body of the carton;

(c) providing a programmable sequence controller for sequentially controlling release of the biasing means and closing of the bottom end flaps; (d)

closing the bottom end flaps in a preset sequence wherein the second end flap is first folded, followed by folding the first and third end flaps, after-which the fourth end flap is folded, under control of the sequence controller by releasing the bias and folding each end flap towards the interior of the carton while maintaining a bias on each unfolded end flap; and (e) providing the end flaps in a secure position by means of inserting the free corners of the fourth end flap into L-slide locks in the first and third end flaps.

3. A method for closing the bottom end flaps of a rectangular carton having sequentially adjacent first, second, third and fourth sides which form the body of the carton, the four sides having first, second, third and fourth bottom end flaps extending respectively therefrom, the first and fourth end flaps having inwardly inclined edges on the sides of such flaps that contact each other when in a closed position, the method including the steps of:

(a) providing a carton in an expanded rectangular position having its bottom end flaps extending downward relative to the body of the carton;

(b) providing biasing means to bias said end flaps outwardly with respect to the sidewalls of the body of the carton;

(c) providing a programmable sequence controller for sequentially controlling release of the biasing means and closing of the bottom end flaps;

(d) closing the bottom end flaps in a preset sequence of first, second, third and fourth end flaps under control of the sequence controller by releasing the bias and folding each end flap towards the interior of the carton while maintaining a bias on each unfolded end flap; and (e) providing the end flaps in a secure position by means of disposing the inwardly inclined edges of the first and fourth end flaps in locking relationship to each other.

4. A method for closing the bottom end flaps of a rectangular carton having sequentially adjacent first, second, third and fourth sides which form the body of the carton, and the four sides having first, second, third and fourth bottom end flaps extending respectively therefrom, the first and third end flaps having angular cut-out and tabbed side edges and the fourth end flap having inclined side edges and an extended longitudinal free edge, the method including the steps of:

(a) providing a carton in an expanded rectangular position having its bottom end flaps extending downward relative to the body of the carton;

(b) providing biasing means to bias said end flaps outwardly with respect to the sidewalls of the body of the carton;

(c) providing a programmable sequence controller for sequentially controlling release of the biasing means and closing of the bottom end flaps;

(d) closing the bottom end flaps in a preset sequence wherein the second end flap is folded first, followed by folding the first and third end flaps, after-which the fourth end flap is folded under control of the sequence controller by releasing the bias and folding each end flap towards the interior of the carton while maintaining a bias on each unfolded end flap; and (e) providing the end flaps in a secure position by means of pushing the tabs of said first and third end flaps and the extended longitudinal edge of said fourth end flap past the longitudinal edge of said second end flap so as to secure all end flaps in locking relation.

* * * * *